US006293423B1

(12) United States Patent
Masuda et al.

(10) Patent No.: US 6,293,423 B1
(45) **Date of Patent: *Sep. 25, 2001**

(54) CAP-MEMBER

(75) Inventors: Satoki Masuda, Shizuoka; Kouichi Shirouzu, Aichi, both of (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/175,411

(22) Filed: Oct. 20, 1998

(30) Foreign Application Priority Data

Oct. 21, 1997 (JP) ..... 9-288668

(51) Int. Cl.[7] ..... B65D 41/16; B65D 45/16
(52) U.S. Cl. ..... 220/784; 220/326
(58) Field of Search ..... 220/784, 795, 220/324, 326, 284, 288, 300, 786; 215/317, 263, 272, 302, 318, 321

(56) References Cited

U.S. PATENT DOCUMENTS

| | | | | |
|---|---|---|---|---|
| 1,609,078 | * | 11/1926 | Floyd et al. | 215/317 |
| 2,019,376 | * | 10/1935 | Wilhelm | 220/795 |
| 2,254,559 | * | 9/1941 | Andresen | 220/784 |
| 3,499,574 | * | 3/1970 | Yates, Jr. | 220/784 |
| 3,776,406 | * | 12/1973 | Milbourne, Sr. | 215/321 X |
| 4,214,782 | * | 7/1980 | Boyer | 220/326 |
| 4,966,302 | * | 10/1990 | Hjordie | 220/784 |
| 5,147,060 | * | 9/1992 | Lima et al. | 220/326 |
| 5,449,086 | * | 9/1995 | Harris | 220/288 |
| 5,918,956 | * | 7/1999 | Scholder | 220/786 |

FOREIGN PATENT DOCUMENTS 1 599 743 10/1981 (GB) .

* cited by examiner

*Primary Examiner*—Allan N. Shoap
*Assistant Examiner*—Niki M. Eloshway
(74) *Attorney, Agent, or Firm*—Armstrong, Westerman, Hattori, McLeland & Naughton

(57) ABSTRACT

A locking structure of a cap-member to a cylindrical body, being capable of giving sufficient resilience to a locking arm formed on the cap-member, is provided, which consists of: a resilient locking arm provided on a peripheral wall of the cap-member in a peripheral direction thereof; and an engaging groove provided on the cylindrical body for engaging the locking arm simultaneously with fitting of the cap-member on the cylindrical body. The locking arm is provided with an engaging projection projecting from a free end portion thereof toward a longitudinal axis of the cap-member and having a tapered surface inclined in a fitting direction of the cap-member and an engaging plane on a back of the tapered surface to engage the engaging groove. A plurality of the locking arms are arranged on the peripheral wall of the cap-member. The locking structure may further include an annular sealing member to be retained between the cap-member and a holder body formed continuously from the cylindrical body. The cap-member is axially fixed to the cylindrical body by means of the engaging plane of the locking arm and an annular plane inside the cap-member. Thus, a locking structure capable of easily and surely locking the cap-member to the cylindrical body can be realized.

7 Claims, 4 Drawing Sheets

CAP-MEMBER

BACKGROUND OF THE INVENTION

1. Field of the Invention

The present invention relates to a structure for locking a cap-member to a cylindrical body.

2. Description of the Related Art

FIGS.5 and 6 show a prior art locking structure of a cap-member to a cylindrical body disclosed in Japanese Patent Application Laid-open No. 7-153529 (hereinafter "JP '529").

In this structure, a plurality of locking projections 53, facing each other, are provided on an inner surface of a peripheral wall 52 of a cap-member 51, and an annular engaging groove 55 relative to the locking projections 53 is provided on a cylindrical body 54.

With respect to the above structure of JP '529, however, the cap-member 51 having been locked to the cylindrical body 54 can not be easily detached since the locking projections 53 are not resilient.

Further, the locldng projection 53 is apt to be plastically deformed on fitting of the cap-member 51, which causes incomplete lock of the cap-member 51 to the cylindrical body 54.

Japanese, Patent Application Laid-open No. 8-279372 (hereinafter "JP '372") therefore discloses another locking structure of a cap-member to a cylindrical body as shown in FIGS. 7 and 8.

In this structure, a pair of resilient locking arms 64 with respective slits are provided oppositely to each other in a fitting direction (V-direction) of a cylindrical body 61 and a cap-member 62, and a free end portion of each of the locking arms 64 is provided with a locking projection 65. With respect to the structure of JP '372, however, it would be difficult to make the locking arm 64 have sufficient resilience because of a short arm-length D. D.

SUMMARY OF THE INVENTION

In view of the foregoing, an object of the present invention is to provide a locking structure of a cap-member capable of giving sufficient resilience to a locking arm provided thereon.

In order to achieve the above-described object, as a first aspect of the present invention, a locking structure of a cap-member to a cylindrical body consists of: a resilient locking arm provided on a peripheral wall of the cap-member in a peripheral direction thereof by making a slit on the peripheral wall; and an engaging groove provided on the cylindrical body for engaging the locking arm; wherein the locking arm engages the engaging groove simultaneously with fitting of the cap-member on the cylindrical body so as to easily and surely lock the cap-member to the cylindrical body.

In accordance with a second aspect of the present invention, the locking arm is provided with an engaging projection projecting from a free end portion thereof toward a longitudinal axis of the cap-member, the engaging projection being provided with a tapered surface inclined in a fitting direction of the cap-member for facilitating to fit the cap-member on the cylindrical body and with an engaging plane on a back of the tapered surface to engage the engaging groove.

In accordance with a third aspect of the present invention, a plurality of the locking arms are arranged on the peripheral wall of the cap-member.

In accordance with a fourth aspect of the present invention, the locking structure further includes an annular sealing member to be retained between the cap-member and a holder body, formed continuously from the cylindrical body and having a larger diameter than the cylindrical body, simultaneously with locking of the cap-member to the cylindrical body.

And, in accordance with a fifth aspect of the present invention, the cap-member is axially fixed to the cylindrical body by means of the engaging plane of the locking arm and an annular plane inside the cap-member.

According to the present invention as described hereinabove, since the locking arm is formed on the peripheral wall of the cap-member in a peripheral direction, the locking arm can bend surely and easily even in case of a cap-member with small thickness, thereby enabling easy locking and lock-releasing.

And, since the tapered surface of the engaging projection at the free end portion of the locking arm is inclined in the fitting direction of the cap-member, force for fitting the cap-member on the cylindrical body can be small, thereby facilitating the fitting. This prevents damage of the engaging projection when fitting the cap-member. Also, the cap-member can be locked to the one end portion of the cylindrical body upon fitting the cap-member on the one end portion of the cylindrical body, and simultaneously the cap-member can be positioned.

Also, since the engaging projection can engage the engaging groove with high holding force by means of the locking arm capable of surely bending and resiling, detachment of the cap-member from the cylindrical body after the locking can be surely prevented.

Further, since a plurality of the locking arms are arranged oppositely to each other on the peripheral wall of the cap-member, the cap-member can be surely locked to the cylindrical body.

Still further, since the sealing member is arranged between the holder body and the cap-member, movement of the sealing member can be surely prevented, and the cap-member can be used as a retainer of the sealing member without using any other member, thereby reducing the production cost.

The above and other objects and features of the present invention will become more apparent from the following description taken in conjunction with the accompanying drawing figures.

BRIEF DESCRIPTION OF THE DRAWING FIGURES

DETAILED DESCRIPTION OF THE PREFERRED EMBODIMENT(S)

Embodiment of the present invention will now be described in further detail with reference to the accompanying drawing figures.

The embodiment described hereinafter is of a case applied, but not limited, to an electric vehicle.

FIGS. 1–4 show an embodiment of a locking structure of a cap-member in accordance with the present invention.

Figure 1:
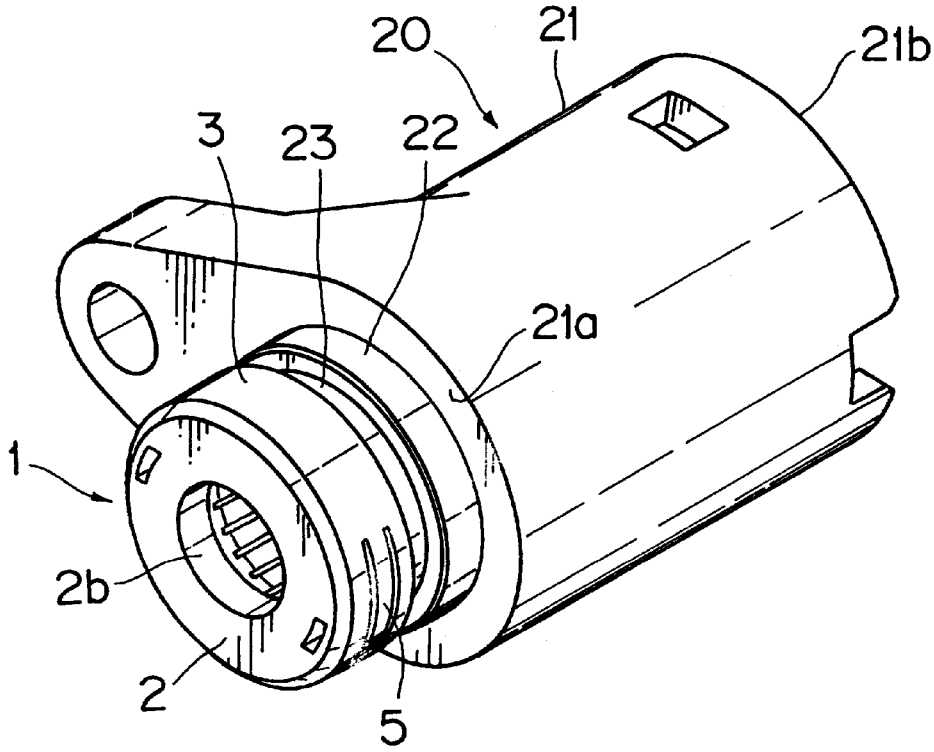
FIG. 1 is a perspective view showing an embodiment of a locking structure of a cap-member in accordance with the present invention.

Referring to FIG. 1, a resin-molded cap-member 1 is provided with a resilient locking arm 5, fitted on a small-diameter cylindrical body 23 provided at one end 21*a* of a cylindrical holder 20 made of aluminum, and locked to the holder 20.

Figure 2:
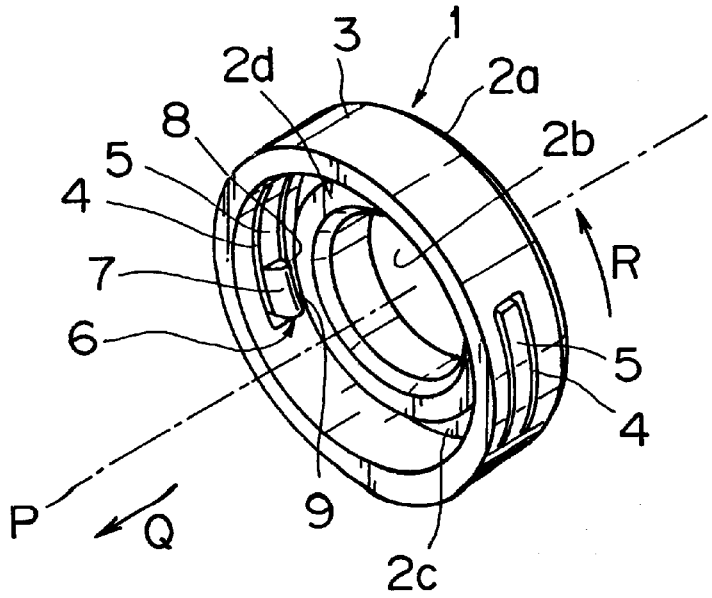
FIG. 2 is a perspective view showing the cap-member of FIG. 1.
Figure 3:
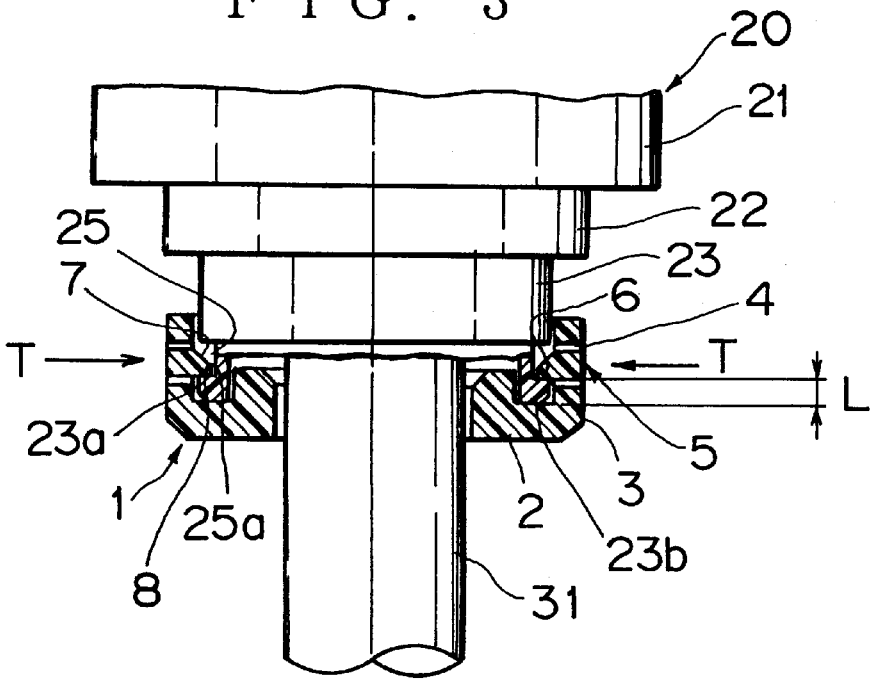
FIG. 3 is a partial plan view, partly in section, of FIG. 1.

As shown in FIGS. 2 and 3, the cap-member 1 is provide with a peripheral wall 3 at a perimeter 2*a* of an annular plate 2, the locking arms 5 on the peripheral wall 3 formed by making respective slits 4 in a peripheral direction (R-direction) thereon, and an engaging projection 6 projecting from a free end portion of each of the locking arms 5 toward a longitudinal axis of the cap-member 1. A through hole 2*b* is formed in the center of the annular plate, and an annular wall 2*d* around the through hole 2*b* is formed on a back 2*c* of the annular plate 2.

The locking arm 5 is capable of bending along the peripheral wall 3. The engaging projection 6 is provided with a tapered surface 7 inclined in a fitting direction (Q-direction) of the cap-member 1, and an engaging plane 8 perpendicular to the longitudinal axis is formed on the back of the tapered surface 7. The tapered surface 7 inclined in the fitting direction (Q-direction) facilitates to fit the cap-member 1 on the cylindrical body 23. And, the engaging plane 8 prevents the cap-member 1 from coming off the cylindrical body 23 after locking the cap-member 1 on the cylindrical body 23.

As is shown in FIGS. 1 and 3, the holder 20 is provided with an intermediate cylinder 22 having the same diameter as the cap-member 1 at the one end 21*a* of a cylindrical holder body 21, the cylindrical body 23 having a smaller diameter continues the intermediate cylinder 22, and a wire or cable 31 is inserted from another end 21*b* through the one end 21*a*. The holder body 21, intermediate cylinder 22, and cylindrical body 23 is continuously formed with the same longitudinal axis. The cylindrical body 23 is annularly provided with an engaging groove 25 on an outer surface of a peripheral wall 23*a*. An electric terminal is pressure-welded on a terminal portion of the wire or cable 31 inserted in the holder 20 and the cap-member 1.

Though the engaging groove 25 relative to the locking arm 5 is formed on the cylindrical body 23 in the present embodiment, these elements may be reversely constructed.

A locking mechanism of the cap-member 1 to the cylindrical body 23 is described hereinafter.

As shown in FIG. 3, when the cap-member 1 is fitted on the cylindrical body 23 from the end 23*b*, the tapered surfaces 7 of the engaging projections 6 abut against the end 23*b* of the cylindrical body 23, and the locking arms 5 are radially bent outwardly. On further advancement of the cap-member 1, tips 9 of the engaging projections 6 slide on the peripheral wall 23*a* of the cylindrical body 23. On engagement of the tips 9 of the engaging projections 6 with the engaging groove 25 on the cylindrical body 23 by return of the locking arms 5 to the original position, the cap-member 1 is locked to the cylindrical body 23, while the annular wall 2*d* on the annular plate 2 is inserted in an interior of the cylindrical body 23.

In comparison with the locking structure of JP '372, the locking arm 5 is surely given much more resilience even in case that a distance L between the end 23*b* and a groove-wall surface 25*a* is short.

Figure 4:
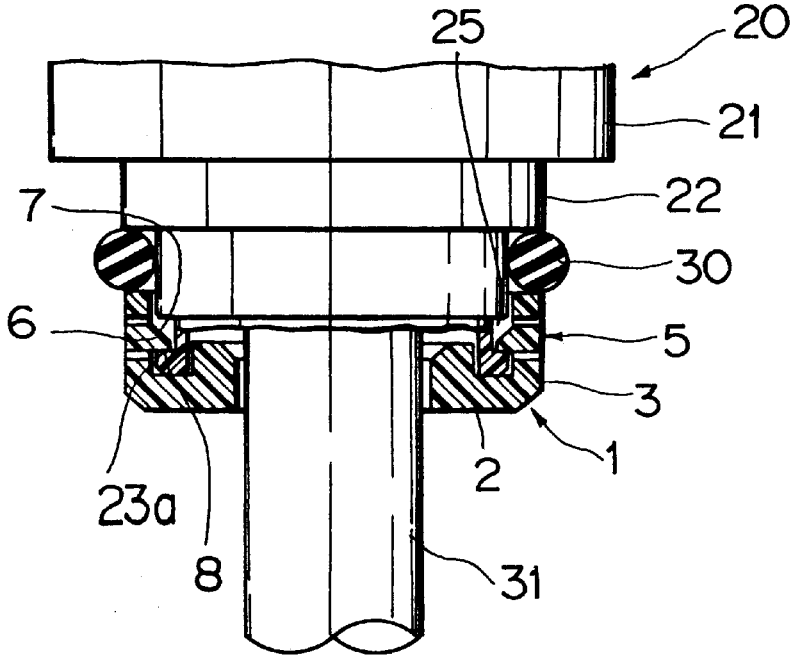
FIG. 4 is a partial plan view, partly in section, showing a state of an O-ring being retained around the cylindrical body.
Figure 5:
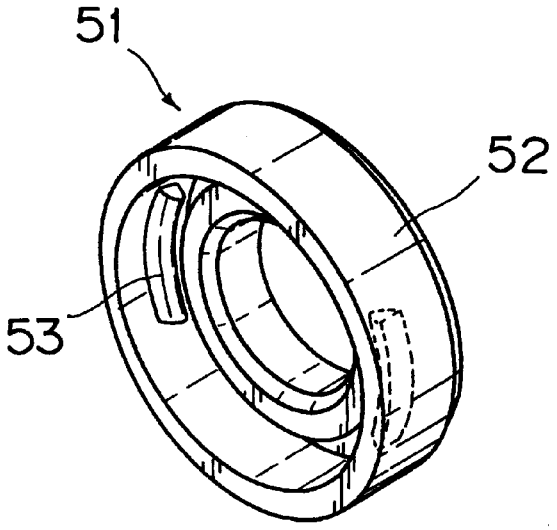
FIG. 5 PRIOR ART
FIG. 5 is a perspective view showing a prior art cap-member.
Figure 6:
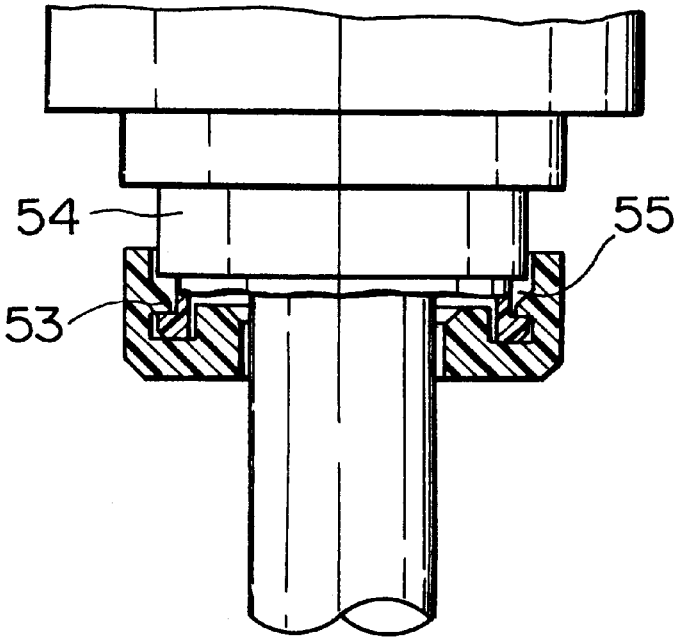
FIG. 6 PRIOR ART
FIG. 6 is a partial plan view, partly in section, showing the cap-member of FIG. 5 being locked to a cylindrical body.
Figure 7:
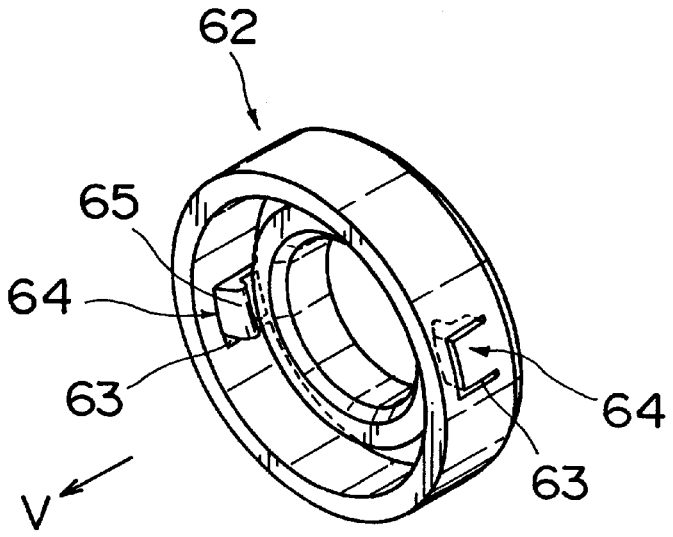
FIG. 7 PRIOR ART
FIG. 7 is a perspective view showing another prior art cap-member.
Figure 8:
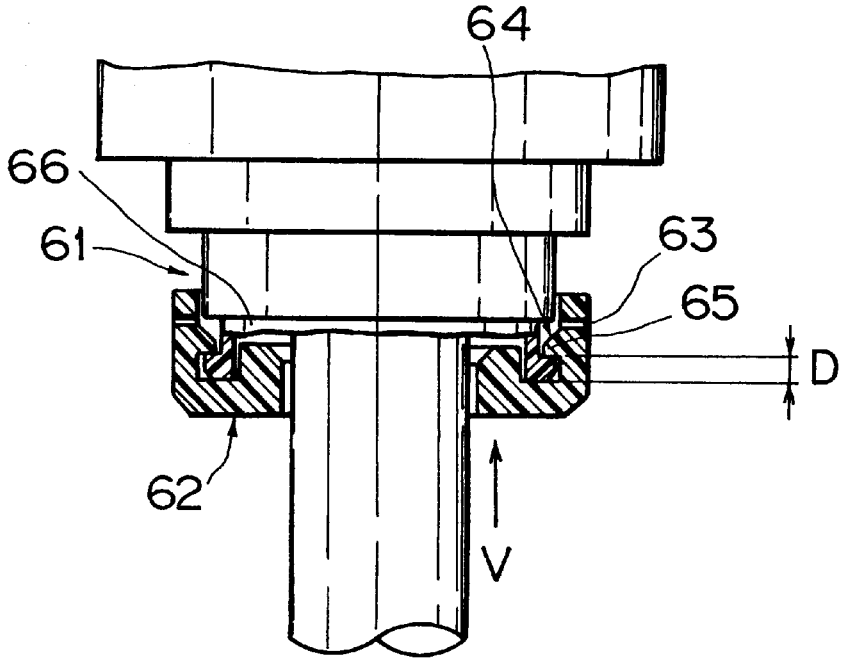
FIG. 8 PRIOR ART
FIG. 8 is a partial plan view, partly in section, showing the cap-member of FIG. 7 being locked to a cylindrical body.

The cap-member 1 can be surely fitted on the cylindrical body 23 even in case of the short distance L, therefore, an O-ring 30 as a sealing member may be set as shown in FIG. 4 by using the cap-member 1 as a pushing member of the O-ring 30.

What is claimed is:

1. A cap-member to be engaged with a cylindrical body having an engaging groove provided thereon, said cap-member, comprising:

a peripheral wall; and an elongated resilient locking arm formed by making a pair of elongated parallel slits, whose ends being connected to each other, on said peripheral wall, wherein said locking arm extends in a circumferential direction of said peripheral wall and has a length more than at least twice a width of said locking arm, wherein said locking arm is provided with an inwardly protruded engaging protrusion integrally formed at a free end thereof and having a length more than at least said width of said locking arm along said circumferential direction, wherein a base of said engaging protrusion has a same width as said width of said locking arm and a height of said engaging protrusion is constant in said circumferential direction, wherein said engaging protrusion is provided with a tapered surface inclined in a fitting direction of said cap-member for facilitating to fit said engaging protrusion in said groove and with a four-sided engaging plane perpendicular to said fitting direction on a back of said tapered surface to engage said engaging groove, and wherein said engaging protrusion engages said engaging groove simultaneously with fitting of said cap-member on said cylindrical body.

2. The cap-member according to claim 1, wherein a plurality of said locking arms are arranged on said peripheral wall.

3. The cap-member according to claim 2, further comprising an annular sealing member to be retained between said cap-member and a holder body, formed continuously from said cylindrical body and having a larger diameter than said cylindrical body, simultaneously with locking of said cap-member to said cylindrical body.

4. The cap-member according to claim 2, wherein said cap-member is axially fixed to said cylindrical body by means of said engaging plane of said locking arm and an annular plane inside said cap-member.

5. The cap-member according to claim 1, further comprising an annular sealing member to be retained between said cap-member and a holder body, formed continuously from said cylindrical body and having a larger diameter than said cylindrical body, simultaneously with locking of said cap-member to said cylindrical body.

6. The cap-member according to claim 5, wherein said cap-member is axially fixed to said cylindrical body by means of said engaging plane of said locking arm and an annular plane inside said cap-member.

7. The cap-member according to claim 1, wherein said cap-member is axially fixed to said cylindrical body by means of said engaging plane of said locking arm and an annular plane inside said cap-member.

* * * * *